United States Patent [19]

Rudt et al.

[11] Patent Number: 4,766,649

[45] Date of Patent: Aug. 30, 1988

[54] PAPERMAKER'S FELT UTILIZING SPECIAL WEB-MAKING TECHNIQUES TO AVOID VIBRATION

[75] Inventors: Robert J. Rudt, Clifton Park; W. Daniel Aldrich, Latham, both of N.Y.

[73] Assignee: Albany International Corp., Menands, N.Y.

[21] Appl. No.: 19,938

[22] Filed: Feb. 27, 1987

[51] Int. Cl.[4] ..... D01G 15/00

[52] U.S. Cl. ..... 19/98; 19/163; 428/280

[58] Field of Search ..... 19/98, 163; 428/280

[56] References Cited

U.S. PATENT DOCUMENTS 4,308,640 1/1982 Bulla et al. ..... 19/163

4,553,289 11/1985 Strobl et al. ..... 19/163

*Primary Examiner*—James J. Bell

*Attorney, Agent, or Firm*—Kane, Dalsimer, Sullivan, Kurucz, Levy, Eisele and Richard

[57] ABSTRACT

A method and an apparatus for avoiding periodic non-uniformities in papermaking felts by varying the width of the web going into a cross lapper.

6 Claims, 1 Drawing Sheet

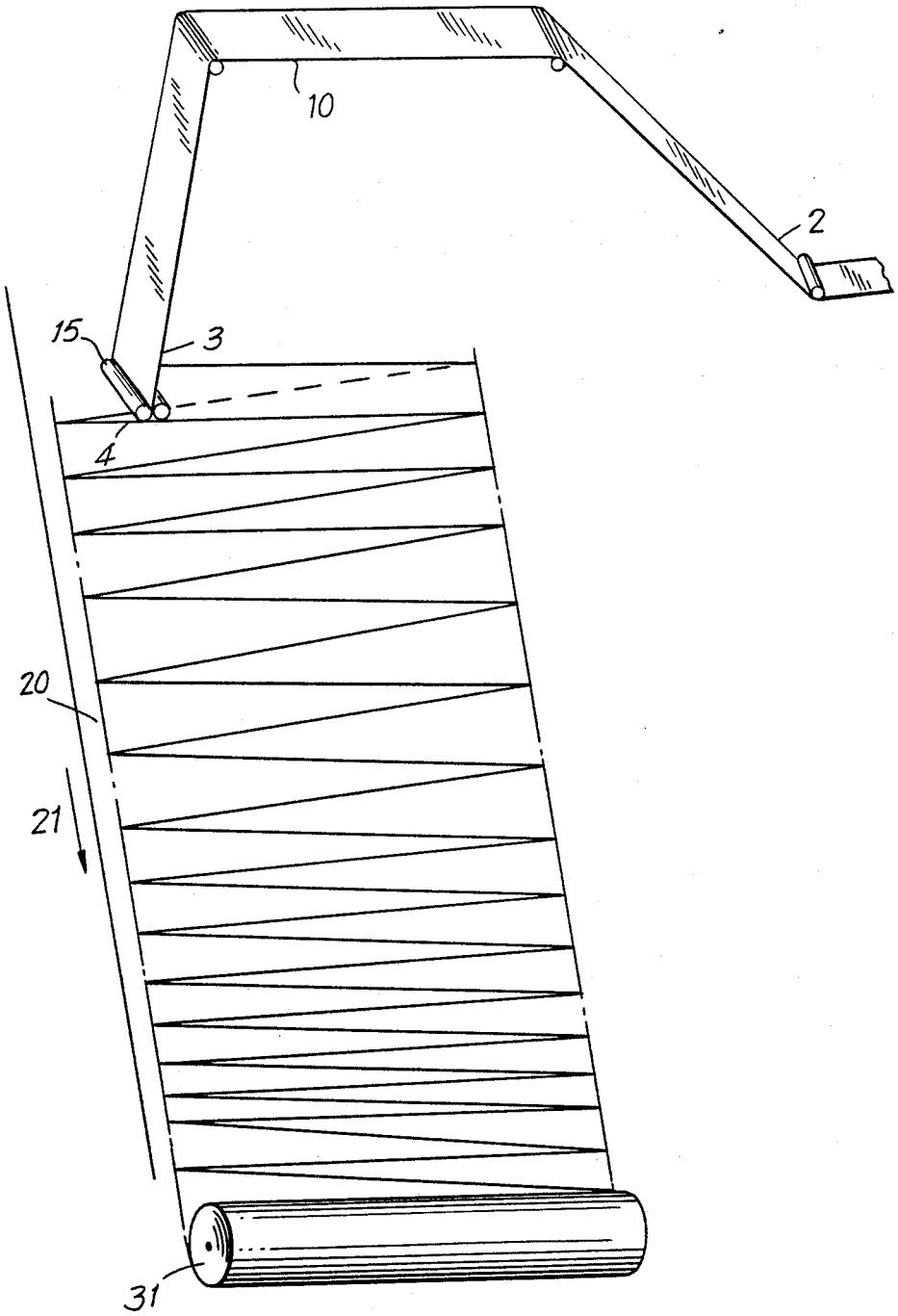
10
2
15
3
4
20
21
31

PAPERMAKER'S FELT UTILIZING SPECIAL WEB-MAKING TECHNIQUES TO AVOID VIBRATION

FIELD OF THE INVENTION

The present invention pertains to papermaking felts. More particularly, the present invention relates to a method of making papermaker's felts having non-periodic nonuniformities.

BACKGROUND OF THE INVENTION

A papermaker's felt must have a high degree of uniformity. Non-uniformities in the papermaker's felt can cause vibration of a paper machine. If these nonuniformities are periodic as a result of the classical procedures used to manufacture wet felts, it is possible to excite the paper machine at the system's natural frequency or at one of the natural frequencies of the components by simply running at the correct speed.

SUMMARY OF THE INVENTION

The principal object of the invention is to provide a method of producing papermaking felts having non-periodic nonuniformities comprising a carded web of fibers, delivering the web to a cross lapper, gradually varying the width of said web delivered to the cross lapper and lapping a plurality of layers of web onto a receiving conveyor as the receiving convevor moves away from the cross lapper so that the cross lapper deposits fibers at an angle from 91 to 113 degrees to the direction of travel of the receiving conveyor, depending on the width of the final batt and the number of layers of web.

The method and apparatus disclosed herein provide a felt with non-periodic nonuniformities. The width of the web used to produce the felt is limited only by the width of available lapping equipment.

These and various other features of novelty which characterize the invention are pointed out with particularity in the claims annexed hereto and forming a part hereof. However, for a better understanding of the invention, its advantages, and objects obtained by its use, reference should be made to the drawings which form a further part hereof, and to the accompanying descriptive nature, in which there is illustrated and described a preferred embodiment of the invention.

BRIEF DESCRIPTION OF THE DRAWING

The FIGURE discloses a perspective view of the novel method and apparatus for producing the non-periodic nonuniformities for the felt which is the subiect of the invention.

DESCRIPTION OF THE PREFERRED EMBODIMENT

The method disclosed herein and illustrated in the FIGURE provides a web of fibers 2 which has been carded in a conventional manner on a card system. The width of said web of fibers is varied and only limited by the width of the machinery through which it travels.

The carded web 2 is conveyed to a cross lapper 10. The web travels and is deposited on a receiving conveyor 20 traveling in direction 21 and is rolled onto a wind-up roller 31. The carded web 2 is deposited on the moving conveyor 20 so that the leading edge 3 coming off the cross lapper lies flush with and touches edge 4 of the prior layer.

In the apparatus, the lower cart 15 travels from left to right on the moving conveyor. The web is laid onto the conveyor 20 with the speed of the incoming web and the conveyor adjusted to produce the edge-to-edge contact described above. The layers of web thus deposited are consolidated into a homogeneous sheet of fibers by means conventional to the art for insuring the layers of web are prevented from ply separating in subsequent processing.

The web of fibers 2 is produced with a varying width. The widths are infinitely variable within the ranges available in the machine and in the specific example disclosed herein the width of the web thus formed is variable within the ranges of 60" minimum and 84" maximum.

While the invention has been particularly shown and described with reference to preferred embodiments thereof, it will be understood by those skilled in the art that variations in form may be made without departing from the spirit and scope of the invention.

What is claimed is:

1. An apparatus for manufacturing papermaker's felt web having non-periodic nonuniformities comprising:

a fiber carding means;

a means for gradually varying the width of said web of fibers;

a conveying means for conveying a web of fibers from said fiber carding means;

a cross lapper for receiving said web of fibers from said conveying means, said cross lapper depositing said web onto a receiving conveyor using reciprocating movements back and forth over said receiving conveyor;

said receiving conveyor moving said web away from said cross lapper as said cross lapper lays said web thereon;

a pivoting means acting on said web of fibers as a unit to form superimposed layers thereof on said receiving conveyor so that the edge of the layer which is being deposited contacts the edge of an adjacent layer previously deposited on said felt web.

2. The apparatus of claim 1 in which the width of said web of fibers is gradually varied from 60" to 84".

3. The apparatus of claim 1 wherein said pivoting means deposits said layers on said conveyor in such a way that said edges of said deposited layers lie at an angle between 91 and 113 degrees relative to the direction of movement of said conveyor.

4. A method of producing a fiber web for a papermaker's felt having non-periodic nonuniformities comprising:

providing a carded web of fibers in the form of a sheet of regulatable width;

varying the width of said web gradually;

delivering said web to a moving conveyor;

applying said web onto said moving conveyor in overlapping layers with a cross lapper which reciprocates in a sideways manner with respect to the direction of movement of said conveyor; and pivoting said cross lapper at each edge of said conveyor so that the edge of the layer being deposited aligns with the edge of an adjacent layer previously deposited on said conveyor.

5. The method of claim 4 wherein the width of said web is gradually varied from 60 inches to 84 inches.

6. The method of claim 4 wherein said edges of said deposited layers lie at an angle between 91 and 113 degrees relative to the direction of movement of said conveyor.

* * * * *